US012674449B2

(12) United States Patent
Ejjabraoui et al.

(10) Patent No.: US 12,674,449 B2
(45) Date of Patent: Jul. 7, 2026

(54) FLUID DELIVERY SYSTEMS PID AUTOTUNING

(71) Applicant: Schneider Toshiba Inverter Europe SAS, Pacy sur Eure (FR)

(72) Inventors: Kamal Ejjabraoui, Gravigny (FR); Albin Ineza, Gargenville (FR); Lucas Savreux, Evreux (FR)

(73) Assignee: Schneider Toshiba Inverter Europe SAS, Pacy sur Eure (FR)

( * ) Notice: Subject to any disclaimer, the term of this patent is extended or adjusted under 35 U.S.C. 154(b) by 0 days.

(21) Appl. No.: 18/978,492

(22) Filed: Dec. 12, 2024

(65) Prior Publication Data

US 2025/0207580 A1 Jun. 26, 2025

(30) Foreign Application Priority Data

Dec. 21, 2023 (EP) ..... 23307322

(51) Int. Cl.

| | |
|---|---|
| ***F04B 49/06*** | (2006.01) |
| ***F04B 17/03*** | (2006.01) |
| ***F04B 49/20*** | (2006.01) |

(52) U.S. Cl.

CPC ..... *F04B 49/065* (2013.01); *F04B 17/03* (2013.01); *F04B 49/20* (2013.01)

(58) Field of Classification Search

CPC ..... F04B 49/06; F04B 49/065; F04B 49/20; F04B 17/03; F04B 2203/0209;

(Continued)

(56) References Cited

U.S. PATENT DOCUMENTS 6,697,767 B2 * 2/2004 Wang ..... G05B 13/042 702/179
8,308,441 B2 * 11/2012 Hamdan ..... G05B 11/42 318/268

(Continued)

OTHER PUBLICATIONS

Hornsey, Stephen, "A Review of Relay Auto-tuning Methods for the Tuning of PID-type Controllers", Jan. 1, 2012, 38 pages, Retrieved from the Internet: URL:https://warwick.ac.uk/fac/cross_fac/iatl/student-research/reinvention/archive/volume5issue2/hornsey/.

(Continued)

*Primary Examiner* — Loren C Edwards
(74) *Attorney, Agent, or Firm* — FIG. 1 Patents

(57) ABSTRACT

A method for calculating PID parameters of a fluid system including a motor driving a pump, a compressor or a fan, including further a feedback sensor providing a feedback signal on the system and a PID regulation controlling the motor speed. The method includes:

after an initial approximation of the fluid system by a first order transfer function with delay where three parameters of the transfer function of the process to be identified are: K Static gain, θ Delay, τ Time constant, one or more sequences of:

a—bypassing the PID regulation and implementing the following processes:

a periodic relay process providing a first point ($\omega_{-180}$; $G_{-180}$) at −180° of phase named critical point, a periodic relay with integration process providing a second point ($\omega_{-90}$; $G_{-90}$) at −90° of phase and, a step injection providing a third point $G_0$ at ω=0° of phase and at null frequency, b—resolving the relevant equations in equation systems according to the points obtained through the processes to calculate the transfer function parameters available among (Continued)

$$K = G_0,\ \tau = \frac{1}{\omega_{-180}}\sqrt{\left(\frac{K}{G_{-180}}\right)^2 - 1},\ \theta = \left(\tan^{-1}(\omega_{-180}\cdot\tau) + \pi\right)\cdot\frac{1}{\omega_{-180}}$$

c—applying the transfer function parameters obtained to calculate PID parameters for the system regulation $$\begin{cases} K_p = \dfrac{\tau}{K\cdot(\lambda+\theta)} \\ T_i = \tau \\ T_d = \theta \end{cases}$$

20 Claims, 6 Drawing Sheets

(58) Field of Classification Search
CPC ..... G05B 11/42; G05B 13/024; H02P 6/06; H02P 6/28; F04C 28/08
See application file for complete search history.

(56) References Cited

U.S. PATENT DOCUMENTS 10,386,808 B2 * 8/2019 Tian ..... G05B 19/042
2018/0246482 A1 8/2018 Tian et al.

OTHER PUBLICATIONS

Hang, C.C. et al., "Relay feedback auto-tuning of process controllers—a tutorial review", Journal of Process Control, vol. 12, Jan. 1, 2002, pp. 143-162.
Byeon, Jeonguk et al., "Third quadrant Nyquist point for the relay feedback autotuning of PI controllers", Korean Journal of Chemical Engineering, vol. 28, No. 2, Feb. 1, 2011, pp. 342-347.
European Search Report and Search Opinion dated Jun. 14, 2024 for corresponding European Patent Application No. EP23307322.0, 14 pages.

* cited by examiner

FLUID DELIVERY SYSTEMS PID AUTOTUNING

TECHNICAL FIELD

This disclosure pertains to the field of regulation of systems such as systems where a pump, a compressor or a fan driven by an electric motor delivers a fluid such as a gas or a liquid to a client system and comprising regulating a pressure, a flow or a temperature of the fluid and more precisely concerns the processes for tuning a PID regulation of such a process.

BACKGROUND ART

It is known to provide regulation of the speed of a pump or a compressor through a regulation of the electric motor driving such pump, compressor or fan. There are however applications where it exists a need to provide a regulation of the flow or pressure of fluid within a fluid system such as piping delivering such fluid to a client system, in particular when such client system is remote from the pump or compressor.

There also exist PID autotuning processes for characterizing the fluid systems and refining the drive commands for regulating the motor speed considering the fluid system characteristics. Known online PID autotuning methods are based on two principles, the step based autotuning method and the relay based autotuning method. Online autotuning means that PID tuning has to be done while the system is functioning. This needs the implementation of a dedicated algorithm.

Step-based autotuning is similar to an offline autotuning based on process identification but is performed online. A command step is applied, in open loop, around a stabilized operating point, and response is recorded in order to enable a process identification such as in Alberto Leva, Filippo Donida "A remote laboratory on PID autotuning;", Proceedings of the 17th World Congress The International Federation of Automatic Control Seoul, Korea, Jul. 6-11, 2008 IFAC Proceedings Volumes, Volume 41, Issue 2, 2008, Pages 8147-8152, Available online 11 Jul. 2008, https://doi.org/10.3182/20080706-5-KR-1001.01376.

Relay based autotuning use techniques such as the Ziegler Nichols closed loop tuning model or methods developed by Astron and Hagglund based on such model see Aström, K. J., & Hägglund, T. "*PID Controllers: Theory, Design, and Tuning*" ISA—The Instrumentation, Systems and Automation Society—Research Triangle Park, North Carolina 1995, ISBN: 1-55617-516-7. These techniques basically enable a stable oscillation to be ascertained by stepping the process variable up and down within an established hysteresis band.

This method consists, around a stabilized operating point, to inject the command through a relay, which switches at each change of error sign as shown in FIG. 3. When relay is active, the PID is bypassed. Since the loop is still closed, there is no risk of instabilities. This procedure will naturally lead the relay to switch at the process critical point frequency, which is a useful point for PID tuning, as proposed by Ziegler-Nichols.

This procedure will naturally lead the relay to switch at the process critical point frequency.

The critical point can thus be defined by:

$$\text{Critical period: } T_{cr} = P$$

$$\text{Critical gain: } K_{cr} = \frac{4 \cdot d}{\pi \cdot a}$$

It corresponds to the point with a phase of −180°: at this phase, gain of controlled process must be lower than 1 to avoid instability: critical gain corresponds to the maximum proportional gain that can be applied to the process to keep stable.

Based on these data, Ziegler-Nichols propose PID settings:

| Type | $K_p$ | $T_i$ | $T_d$ |
|---|---|---|---|
| P | $0.5K_{cr}$ | | |
| PI | $0.4K_{cr}$ | $0.8\ T_{cr}$ | |
| PID | $0.6K_{cr}$ | $0.5\ T_{cr}$ | $0.125\ T_{cr}$ |

Some modifications have to be considered for an industrial use of this method:

- a relay with hysteresis instead of a pure relay should be considered. With a pure relay, a small amount of noise can make the relay switch randomly. By introducing hysteresis, the noise must be larger than the hysteresis width to make the relay switch. In this case, the obtained point doesn't exactly correspond to critical point, but to a point with lower phase. By simplification, this difference may not be considered in the proposed algorithm: phase is supposed to be −180°.
- Manage load disturbance. Indeed, since frequent and large load changes are often encountered in industrial processes, any identification procedure should be able to, at least, detect load changes, more positively, to find a quality process model under load disturbance.
  - Under load disturbance, a relay feedback test results in an asymmetrical oscillation.
  - To restore symmetry, a relay bias has to be considered: a load disturbance can be seen as a command offset.

The procedure described in Cheng-Ching Yu, "Autotuning of PID Controllers—A Relay Feedback Approach", Springer, ISBN978-1-4471-3636-1 Published: 17 Apr. 2013 is used to adjust the relay bias until symmetry of oscillation is restored.

Basic relay method leads to PID tuning using Ziegler-Nichols settings but a problem is that these settings are not correlated to typical process characteristic: it is thus difficult to validate these settings with confidence.

SUMMARY

In view of the situation, the present disclosure provides a method adapted to estimate, by an online procedure, a process transfer function, without any process a-priori knowledge to provide a complete PID tuning of a process with PID control.

The proposed method for calculating PID parameters of a system comprising a motor driving a pump, a compressor or a fan to deliver a fluid such as a gas or a liquid to a client system and comprising regulating a pressure, a flow or a temperature of the fluid, comprising further a feedback sensor providing a feedback signal on the system and a PID regulation controlling the motor speed, comprises:

- an initial approximation of the fluid system by a first order transfer function with delay of the form $$P_{estim}(S) = \frac{K \cdot e^{-\theta s}}{1 + \tau \cdot s}$$

where the three parameters of the transfer function of the process to be identified for calculating the PID are:

K Static gain,

θ Delay,

τ Time constant, and one or more sequences of:

a—bypassing the PID regulation and implementing the following processes:

a periodic relay process providing a first point ($\omega_{-180}$; $G_{-180}$) at −180° of phase named critical point, a periodic relay with integration process providing a second point ($\omega_{-90}$; $G_{-90}$) at −90° of phase and, a step injection providing a third point $G_0$ at ω=0° of phase and at null frequency, b—resolving the relevant equations in the equation system:

$$G_0 = K$$

$$G_{-90} = \frac{K}{\sqrt{1+(\tau\cdot\omega_{-90})^2}}$$

$$\cos(\omega_{-90}\cdot\theta) - \omega_{-90}\cdot\tau\cdot\sin(\omega_{-90}\cdot\theta) = 0$$

$$G_{-180} = \frac{K}{\sqrt{1+(\tau\cdot\omega_{-180})^2}}$$

$$\sin(\omega_{-180}\cdot\theta) - \omega_{-180}\cdot\tau\cdot\cos(\omega_{-180}\cdot\theta) = 0$$

according to the points obtained through said processes to calculate the transfer function parameters available among:

$$K = G_0$$

$$\tau = \frac{1}{\omega_{-180}}\sqrt{\left(\frac{K}{G_{-180}}\right)^2 - 1}$$

$$\theta = \left(\tan^{-1}(\omega_{-180}\cdot\tau) + \pi\right)\cdot\frac{1}{\omega_{-180}}$$

c—applying the transfer function parameters obtained to calculate PID parameters for the system regulation:

$$\begin{cases} K_p = \dfrac{\tau}{K\cdot(\lambda+\theta)} \\ T_i = \tau \\ T_d = \theta \end{cases}$$

This method provides a more complete detection of the PID parameters than prior art methods.

Preferably for fluid application processes where the time constant is large, $T_d$ is approximated to zero since the derivative term is not necessary.

Calculating said parameters starting from the estimated transfer function $P_{estim}(S)$, and considering the gain at pulsation w is preferably done through the formula:

$$|P_{estim}(j\cdot\omega)| = \frac{K}{\sqrt{1+(\tau\cdot\omega)^2}}$$

and the phase at pulsation ω done through the formula:

$$\arg(P_{estim}(j\cdot\omega)) = \varphi = \tan^{-1}\left(-\frac{\sin(\omega\cdot\theta)+\omega\cdot\tau\cdot\cos(\omega\cdot\theta)}{\cos(\omega\cdot\theta)-+\omega\cdot\tau\cdot\sin(\omega\cdot\theta)}\right.$$

and according to said processes implemented:

a—through the step injection, calculating the gain $G_0$ with the step injection giving a point at null frequency & phase;

b—through the periodic relay, calculating a Pulsation: $\omega_{-180}$ and a Gain: $G_{-180}=|P_{estim}(j\cdot\omega_{-180})|$ calculating a point at phase=−180°;

c—through the periodic relay with integration, calculating a Pulsation: $\omega_{-90}$ and a Gain: $G_{-90}=|P_{estim}(j\cdot\omega_{-90})|$ calculating a point at phase=−90°.

Said step injection command may comprise bypassing the system PID regulation, inputting a step having an amplitude Δu to the current speed command of the motor, waiting for process feedback convergence, measuring a feedback signal value Δv, calculating said static gain K as Δv/Δu and then reestablishing the system PID regulation.

The step amplitude Δu may be limited in order not to exceed an upper limit sh of the motor speed.

Said periodic relay process may comprise:

bypassing the system PID regulation, providing a series of relay switching on sign changes of the feedback signal, waiting for convergence of the feedback signal, measuring a relay period T, a feedback amplitude A and a relay amplitude d thus providing a critical period $T_u$=T and a critical gain $$K_u = \frac{4.d}{\pi.A/2},$$

reestablishing the system PID regulation.

The relay amplitude d may be limited in order that the motor speed does not to exceed defined upper and lower limits sh, sl.

Said periodic relay with integration process comprises:

bypassing the system PID regulation, applying a series of ramps or relay switching with integration around the last PID output wherein the relay switches on sign change of the feedback signal, analyzing convergence of the feedback signal and when convergence is achieved recording a point at 90° of phase at the relay period T and calculating:

$$\text{Input amplitude: } D = 2\cdot d = G\cdot\frac{T}{2}$$

$$\text{Process period @}-90^\circ\text{ phase: } T_{-90} = T$$

$$\text{Process gain @}-90^\circ\text{ phase: } K_{-90} = \frac{\pi^2}{8}\cdot\frac{A/2}{d} = \frac{\pi^2\cdot a}{8\cdot d}$$

where A is the peak-to-peak amplitude of the feedback signal, D=2·d is the peak-to-peak amplitude of the relay signal, G is the slope of the relay triangle waves, —reestablishing the system PID regulation.

Said step injection, relay method, relay method with integration may be aborted and the PID regulation reestablished if convergence is not achieved within a stipulated time limit or if the feedback signal exceeds a stipulated amplitude limit.

Detecting convergence may comprise periodically providing measures of a feedback signal sample and comparing such to its mean value based on a dedicated number of samples, comparing the absolute difference between said measures and said mean value, confirming achievement of convergence when said absolute difference remains under a defined limit for a specified period of time.

In case one of the methods did not reach convergence, the following calculations may be done to recover missing elements:

If ($\omega_{-90}$; $G_{-90}$) AND ($\omega_{-180}$; $G_{-180}$) are known:
If $G_0$ is known:
$K = G_0$
Else:

$$K = G_{-90} \cdot G_{-180} \cdot \sqrt{\frac{\omega_{-90}^2 - \omega_{-180}^2}{(\omega_{-90} \cdot G_{-90})^2 - (\omega_{-180} \cdot G_{-180})^2}}$$

Or $K = G_{-90} \cdot \sqrt{2}$ in case $\frac{\omega_{-90}^2 - \omega_{-180}^2}{(\omega_{-90} \cdot G_{-90})^2 - (\omega_{-180} \cdot G_{-180})^2}$ is negative $$\tau = \frac{1}{\omega_{-90}} \sqrt{\left(\frac{K}{G_{-90}}\right)^2 - 1}$$

$$\theta = \tan^{-1}\left(\frac{1}{\omega_{-90} \cdot \tau}\right) \cdot \frac{1}{\omega_{-90}}$$

If ($\omega_{-90}$; $G_{-90}$) is known:
If $G_0$ is known:
$K = G_0$
Else:
$K = G_{-90} \cdot \sqrt{2}$ $$\tau = \frac{1}{\omega_{-90}} \sqrt{\left(\frac{K}{G_{-90}}\right)^2 - 1}$$

$$\theta = \tan^{-1}\left(\frac{1}{\omega_{-90} \cdot \tau}\right) \cdot \frac{1}{\omega_{-90}}$$

If ($\omega_{-180}$; $G_{-180}$) is known:
If $G_0$ is known:
$K = G_0$
Else:
$K = G_{-180} \cdot \sqrt{2}$ $$\tau = \frac{1}{\omega_{-180}} \sqrt{\left(\frac{K}{G_{-180}}\right)^2 - 1}$$

$$\theta = \left(\tan^{-1}(\omega_{-180} \cdot \tau) + \pi\right) \cdot \frac{1}{\omega_{-180}}$$

These calculations provide a fallback position in case one of the three proposed processes does not reach convergence or is missing.

The sequence may be repeated from time to time during the operational life of the system to adapt the PID parameters to the ageing of the system.

In a particular embodiment, the present method may comprise further choosing settings between settings based on the hereabove process and settings based on Ziegler Nichols method or choosing settings based on robust gains that is minimal proportional gain, maximal integral time constant and minimal derivative time constant, $$K_p = \min\left(0.4 \cdot K_{cr}; \frac{\tau}{K \cdot (\lambda + \theta)}\right);$$

$T_i = \max(0.8 \cdot T_{cr}; \tau)$; $T_d = 0$ between the results of the present method and Ziegler Nichols settings.

This possibility to choose between different settings providing aggressive tuning, moderate tuning and conservative tuning offers the customer the possibility to adapt the PID to specific needs, for example adapt the PID regulation to promote quick filing of a reservoir in case of flooding or to the contrary adapt the PID regulation to limit pressure variations in a water distribution system.

In the method, once the PID parameters are calculated the PID regulation is re-established with the calculated parameters.

BRIEF DESCRIPTION OF DRAWINGS

Other features, details and advantages will be shown in the following detailed description and on the figures, on which.

In present designs of control systems of pumps for hydraulic systems, regulation comprises a transfer function-based method which is a simple PI method. With this method, a simple PI tuning rule can be obtained, based on estimation of process as a first order transfer function, with delay.

Figure 1:
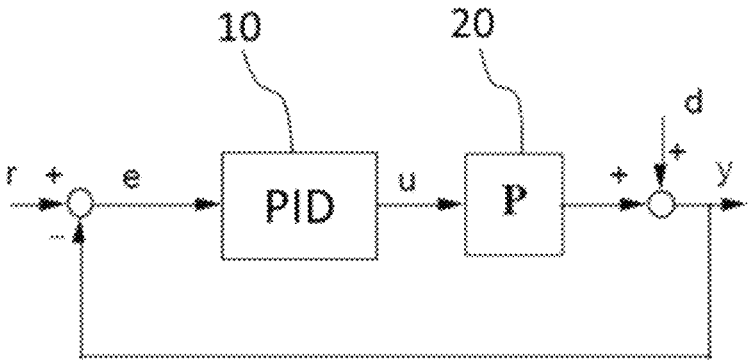
FIG. 1 shows a basic closed loop process with PID.

In a fluid delivery system, a PID 10+Process 20 is approximated in accordance with FIG. 1. The transfer function of such a process is given hereunder where U(s), and E(s) represent respectively the Laplace transforms of the command and error between the process P feedback and target.

$$U(s) = K_p \cdot \left(1 + \frac{1}{T_i \cdot s} + T_d \cdot \frac{s}{1 + \frac{T_d}{N} \cdot s}\right) \cdot E(s)$$

In fluid delivery application the process transfer function may be assimilated to a first order function with a delay, thus, the structure of the process transfer function P(s) becomes:

$$P(s) = \frac{K \cdot e^{-s\theta}}{\tau \cdot s + 1}$$

where three parameters of the transfer function of the process must be identified: K which is the Static gain, $\tau$ which is the time constant and $\theta$ which is the delay of the process.

Figure 2:
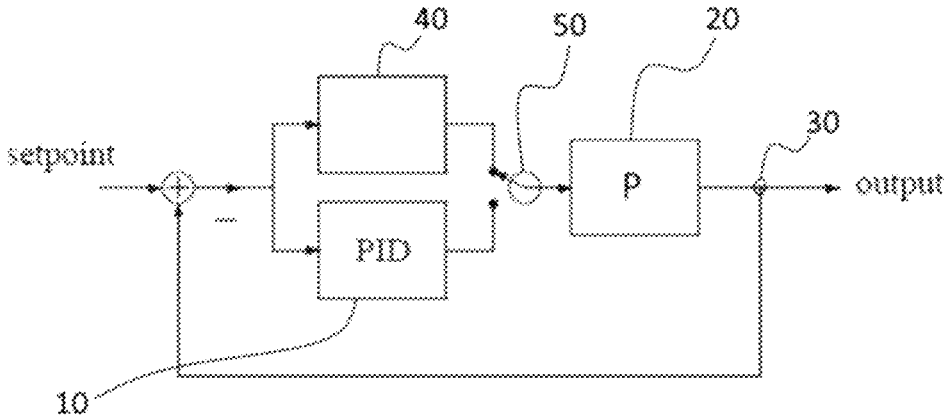
FIG. 2 shows simplified schematics of PID bypass implementation.
Figure 4:
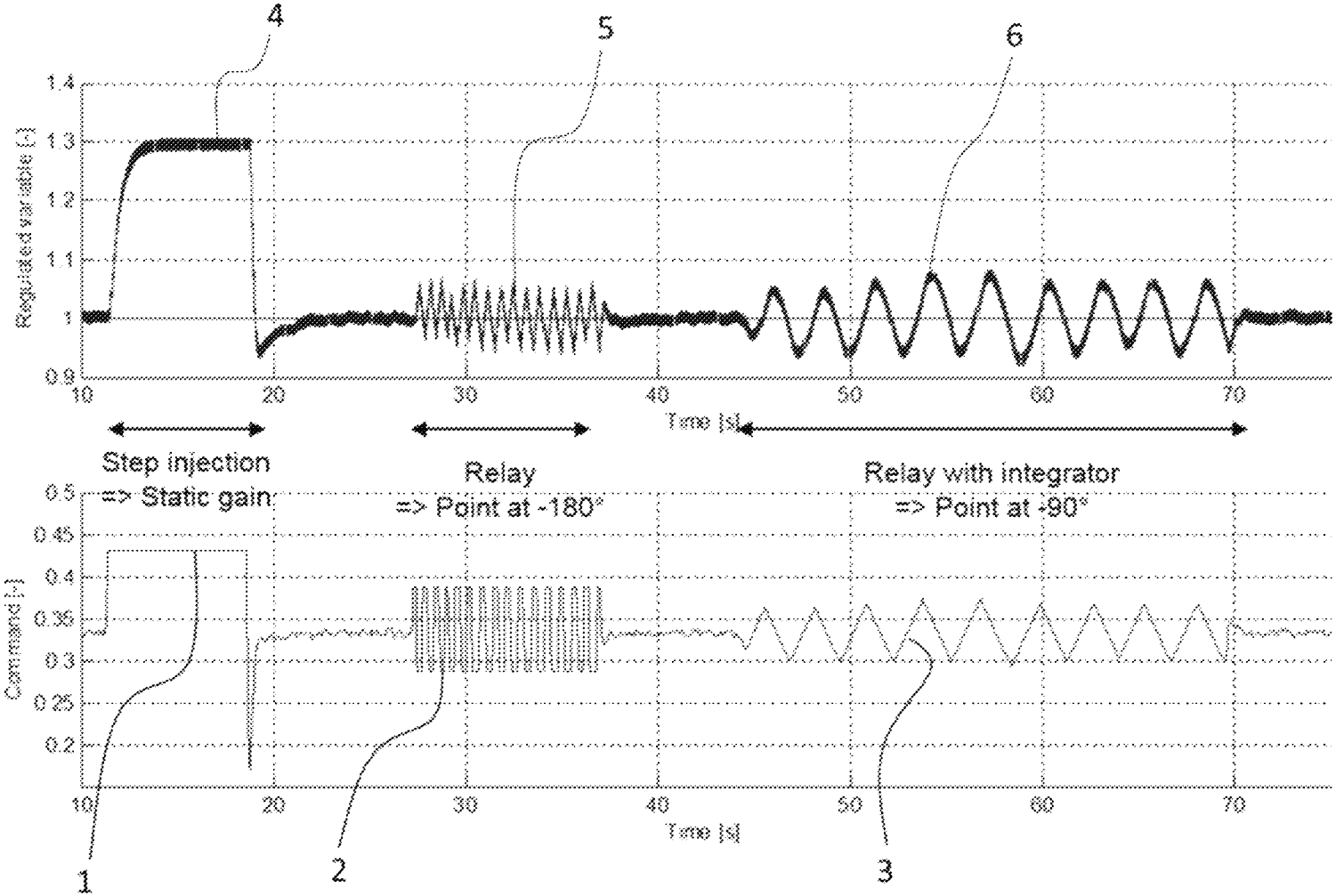
FIG. 4 shows an input signal with a series of commands of the present disclosure and corresponding output signals.
Figure 6:
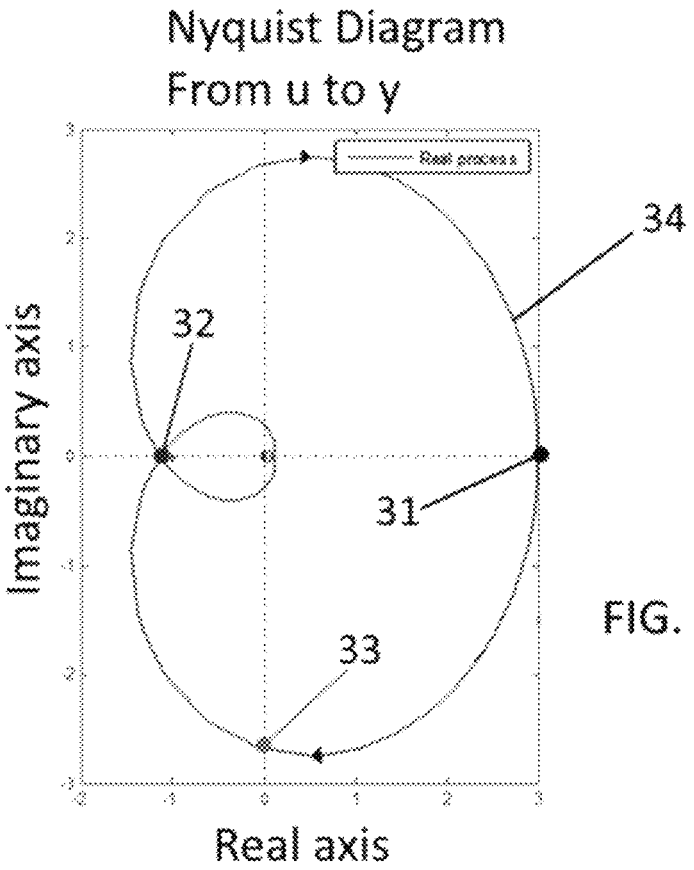
FIG. 6 shows a Nyquist diagram of a process.

A principle of the tuning method of the present disclosure is shown in FIG. 2 where the PID regulation 10 is disconnected from the process 20 and replaced by a specific command module 40 keeping the closed loop structure between a setpoint and an output of the process;

The commands of the PID tuning method used in the present disclosure are, as shown in FIG. 4, a combination of a step injection 1, a periodic relay command 2 also called relay method and a periodic relay with integration command 3 also called relay method with integration which will be discussed hereunder. The combination of step injection 1, periodic relay command 2 and periodic relay with integration 3 allows to identify three points of the process transfer function on the Nyquist curve 34, as illustrated in FIG. 6 in reference with the processes in FIG. 4:

- The point 32 at −180° of phase (critical point) is obtained with the relay method 2,
- The point 33 at −90° of phase is obtained by adding an integrator 3 in series after the relay, providing a relay method with integration or periodic relay with integration,
- The 31 point at 0° of phase corresponds to the process static gain: it is obtained by the step injection 1.

The need to identify various points in the Nyquist curve is that with the critical point only, the −90° point only or the 0° point only, and without any process knowledge, an infinity of transfer function can correspond to such points. To approximate the correct transfer function least 2 points are thus needed. But the accuracy of estimation can vary with the processes and with identified points and a more precise determination of such transfer function is necessary. With the step injection 1, periodic relay command 2 also called relay method and periodic relay with integration command 3 present disclosure provides a more accurate determination of the transfer function.

Figure 5:
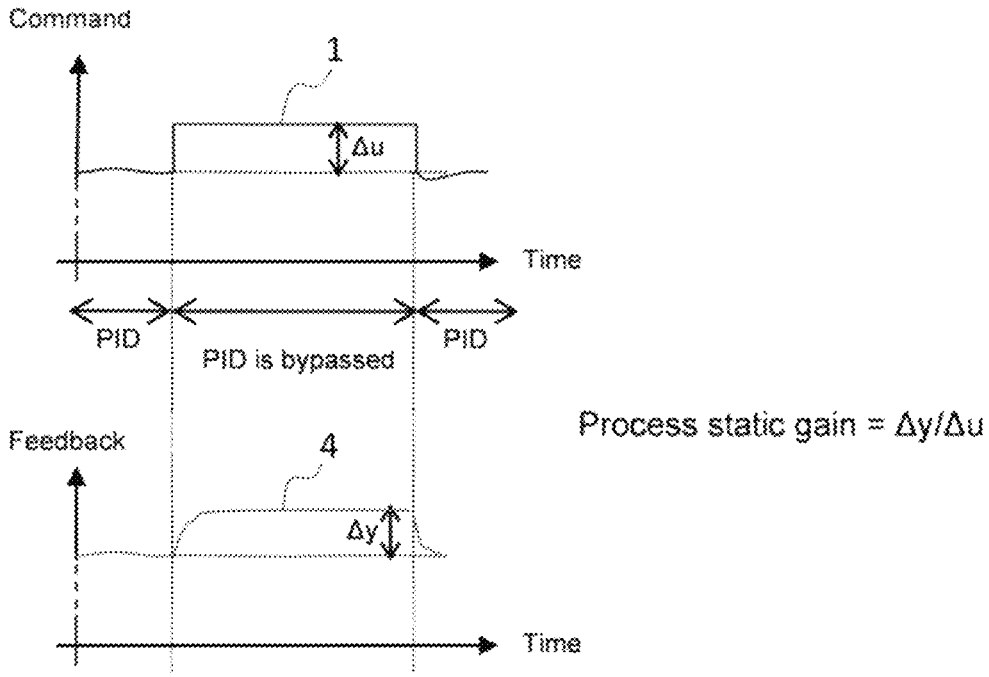
FIG. 5 shows input and output curves after a step injection.

Step Injection Procedure:

The role of the step injection 1 is to estimates the process static gain. The procedure starts with a bypass of the PID command, and the application in input of the process a user defined pump motor speed increase step Δu above a last PID output as in FIG. 5. The user defined speed increase step 1 may be reduced to prevent from command limitation overshoot or to prevent exceeding the maximum pump motor speed.

Then the process awaits convergence at the output sensor and when convergence is obtained that is when after periodically providing samples of a feedback signal 4 ΔY at the sensor 30 of FIG. 2 during the step injection and comparing the absolute difference between said samples to a mean value of such signal in a dedicated number of samples, confirming achievement of convergence when said absolute difference remains under a defined limit for a specified period of time.

When convergence is obtained, the process static gain K is estimated as being ΔY/ΔU, and the PID control is reconnected.

Figure 3:
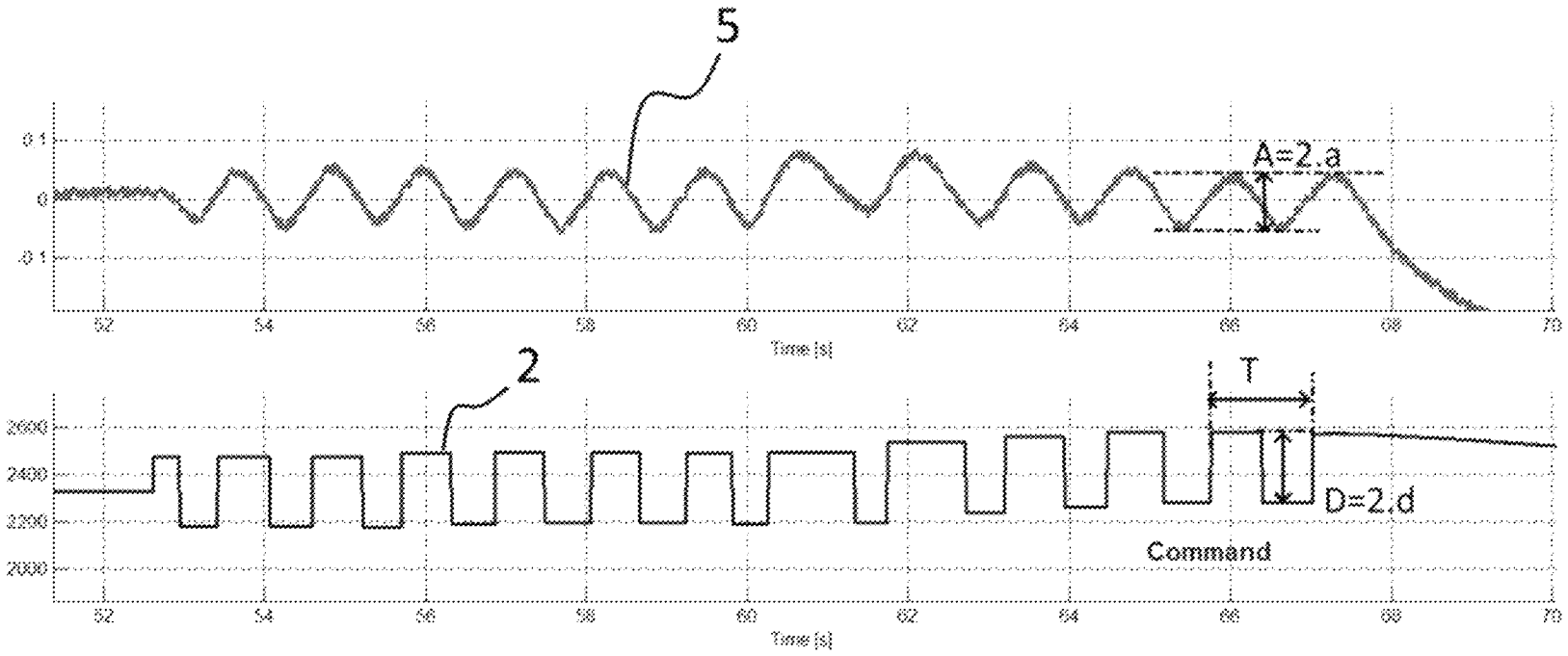
FIG. 3 is a known periodic relay command input signal and an output signal of the process.

Basic Relay Method Procedure:

The basic relay method depicted in FIG. 3 provides a periodic relay command 2, that is step increases and decrease of the motor speed. This method starts with a bypass of the PID command, comprises the application of a first step as a relay switch and then the relay switches to increase and decrease the pump motor speed around the last PID output on sign change of the output signal 5 at sensor 30 of FIG. 2. In this process having the input and output curves shown in FIG. 3, a hysteresis is considered in order to prevent from inopportune switching due to noise and a bias is applied in order to ensure a symmetrical shape of relay (if not, it means that process is non-linear, or that a load disturbance intervenes).

The relay amplitude 2·d is defined by the user but is corrected if it leads to command limitation overshoot.

Convergence of relay's period and of feedback variation's amplitude is analyzed and if convergence is obtained the critical point can thus be recorded, from relay period T, feedback amplitude A=2·a, and relay gain d:

Critical Period:

$$T_u = T$$

Critical Gain:

$$K_u = \frac{4 \cdot d}{\pi \cdot A/2} = \frac{4 \cdot d}{\pi \cdot a}$$

This procedure will naturally lead the relay to switch at the process critical point frequency.

The critical point is then the point with a phase of −180°: at this phase, gain of the controlled process must be lower than 1 to avoid instability: critical gain corresponds to the maximum proportional gain that can be applied to the process to keep it stable.

If a convergence of the output is not achieved, or in case of abnormal non-relay switching, procedure is aborted.

As said, the relay method gives a point at phase=−180° and provides $$\text{Pulsation: } \omega_{-180};$$

$$\text{Gain: } G_{-180} = |P_{estim}(j \cdot \omega_{-180})|.$$

At the end of the procedure, the PID is then reconnected, and a next step is activated.

Figure 7:
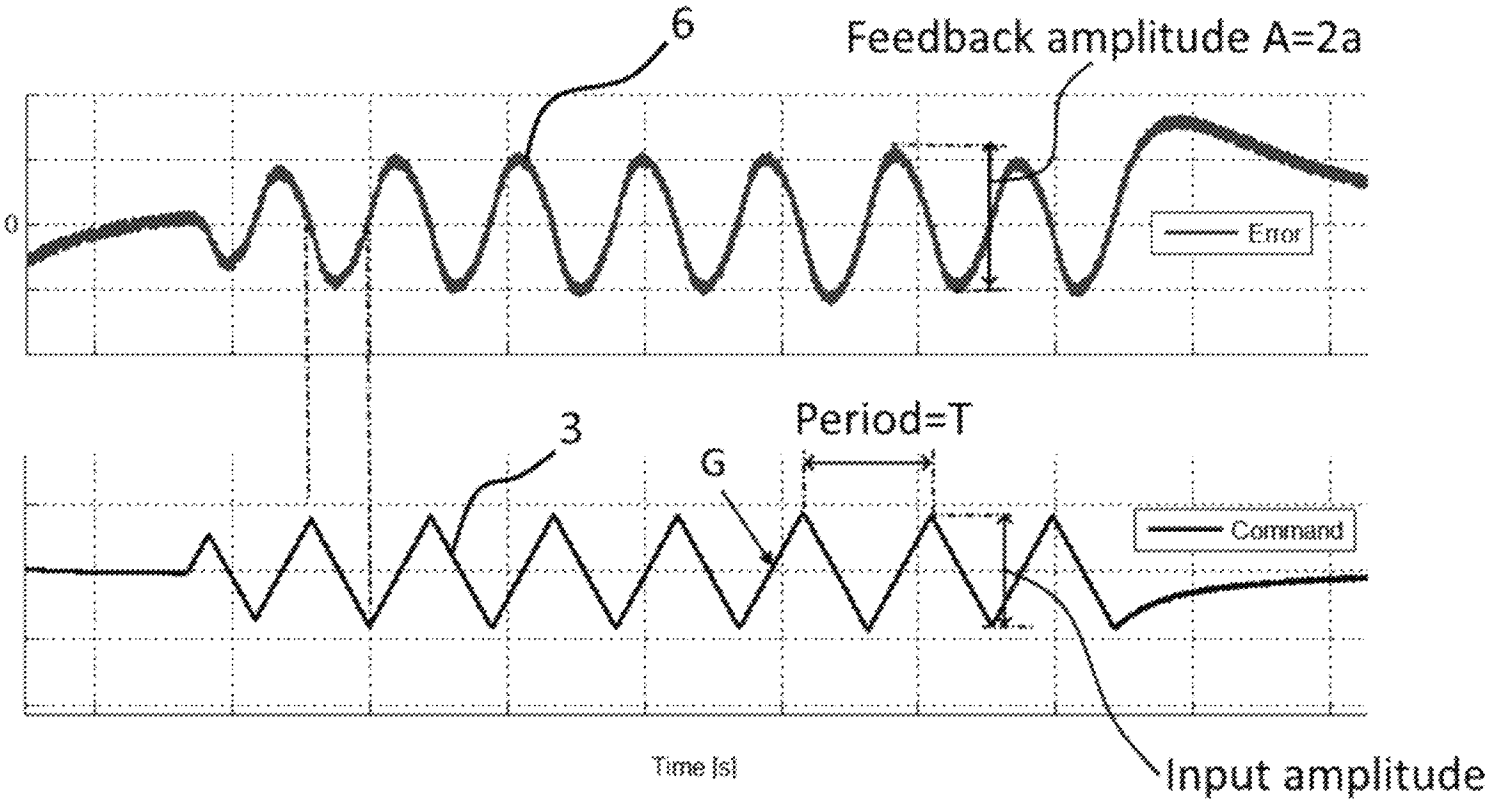
FIG. 7 shows a relay with integration command example.

Relay Method with Integration Procedure:

In this method, the PID is disconnected, and the motor speed is increased and decreased with ramps as shown in FIG. 7.

The role of this procedure is to estimate the process point at −90° of phase using the relay with integration method. This method is based on the relay method but adds add an integrator at the relay output.

This procedure also bypasses the PID command and applies a succession of ramp signals 3 starting from the last PID output. In this case also, the relay switches on sign change of the feedback signal 6. An hysteresis is considered in order to prevent from inopportune switching due to noise, the relay amplitude is defined by the user, but is corrected if it leads to command limitation overshoot.

The main difference with the relay method is the integration applied at the relay output. The integration is stopped if the command limitation of the motor is reached. As in FIG. 7, the slope is the gain G of the relay method.

Convergence of relay's period and of feedback variation's amplitude is analysed and if it's achieved a point at −90° of phase can thus be recorded taking into account the relay period T, relay gain G and the feedback amplitude A.:

$$\text{Input amplitude: } D = 2 \cdot d = G \cdot \frac{T}{2}$$

$$\text{Process period @}-90^\circ\text{ phase: } T_{-90} = T$$

$$\text{Process gain @}-90^\circ\text{ phase: } K_{-90} = \frac{\pi^2}{8} \cdot \frac{A/2}{d} = \frac{\pi^2 \cdot a}{8 \cdot d}$$

Here also If convergence is not achieved, the procedure is aborted.

At the end of this procedure, the PID is then reconnected, and the next step of the process is activated.

The Relay with integration method provides:

$$\text{Pulsation: } \omega_{-90}$$

$$\text{Gain: } G_{-90} = |P_{estim}(j \cdot \omega_{-90})|$$

Back to FIG. 1, the global closed loop transfer function is defined by:

$$\frac{y}{r} = +\frac{C \cdot P}{1 + C \cdot P}$$

And the desired closed loop global function specification is then:

$$\frac{y}{r} = \frac{e^{-s\theta}}{\lambda \cdot s + 1}$$

$$C \approx \frac{1}{P} \cdot \left( \frac{e^{-s\theta}}{(\lambda + \theta) \cdot s + 1} \right)$$

With λ being the global time constant of the system in closed loop.

Which means:

$$C = \frac{\tau}{K \cdot (\lambda + \theta)} \cdot \left(1 + \frac{1}{\tau \cdot s}\right)$$

Then based on the process transfer function parameters (K, τ, θ) that are its poles, zeros and transport delays that have been identified with the three steps procedure above, we can identify the parameter of the PID controller as:

$$\begin{cases} K_p = \dfrac{\tau}{K \cdot (\lambda + \theta)} \\ T_i = \tau \\ T_d = 0 \end{cases}$$

In fluid applications, such as processes dealing with gas or liquid the derivative term is set to 0 since the concerned processes are slow and do not need a derivative correction term. Tuning parameter for the global time constant A, depending on the requirement of the customer is:

$$\lambda = \alpha \cdot \max(\tau, \theta)$$

Where α can be configured between [0.1 to 2] depending on the customer requirement, for example according to the known designations:

| | |
|---|---|
| α = 0.5 | Aggressive tuning |
| α = 1 | Moderate tuning |
| α = 2 | Conservative tuning |

As discussed above, based on the periodic relay command, Ziegler-Nichols proposes the PID settings:

| Type | $K_p$ | $T_i$ | $T_d$ |
|---|---|---|---|
| P | $0.5K_{cr}$ | | |
| PI | $0.4K_{cr}$ | $0.8\ T_{cr}$ | |
| PID | $0.6K_{cr}$ | $0.5\ T_{cr}$ | $0.125\ T_{cr}$ |

It is also possible to select settings corresponding to most robust settings between settings based on the proposed process estimation with step injection, periodic relay command and periodic relay command with integration and settings based only on Ziegler Nichols: minimal proportional gain, maximal integral time constant and minimal derivative time constant. This allows to always have a process response as a first order transfer function without any overshoot to avoid oscillation in the system.

The customer then has the choice between different settings depending on the process response that he wants to have in his system depending on the application:

A—Settings based on Ziegler Nichols method:

$$K_p = 0.4 \cdot K_{cr};\ T_i = 0.8 \cdot T_{cr};\ T_d = 0$$

where $K_{cr}$ and $T_{cr}$ are the critical gain and period identified within the relay base method.

This method provides a quick process response with some oscillations such as overshoot and damping.

B—Settings based the disclosed method providing a Transfer function identification with relay method, relay+integrator and step injection:

$$K_p = \frac{\tau}{K \cdot (\lambda + \theta)};\ T_i = \tau;\ T_d = 0$$

Where (K, τ, θ) are the identified transfer function parameters from the present procedure. This allows different process responses: aggressive, moderate, and conservative without oscillations except small overshoot with conservative tunning. The process will behave as a first order transfer function with delay and the response time will depend on the tunning choice.

C—Settings based on the most robust gains (minimal proportional gain, maximal integral time constant and minimal derivative time constant)

$$K_p = \min\left(0.4 \cdot K_{cr};\ \frac{\tau}{K \cdot (\lambda + \theta)}\right);\ T_i = \max(0.8 \cdot T_{cr};\ \tau);\ T_d = 0$$

between the present method based on the three processes periodic relay, periodic relay with integration and step injection and the Ziegler Nichols method. These last settings provide a robust process response without any oscillation and overshoot.

Figure 8:
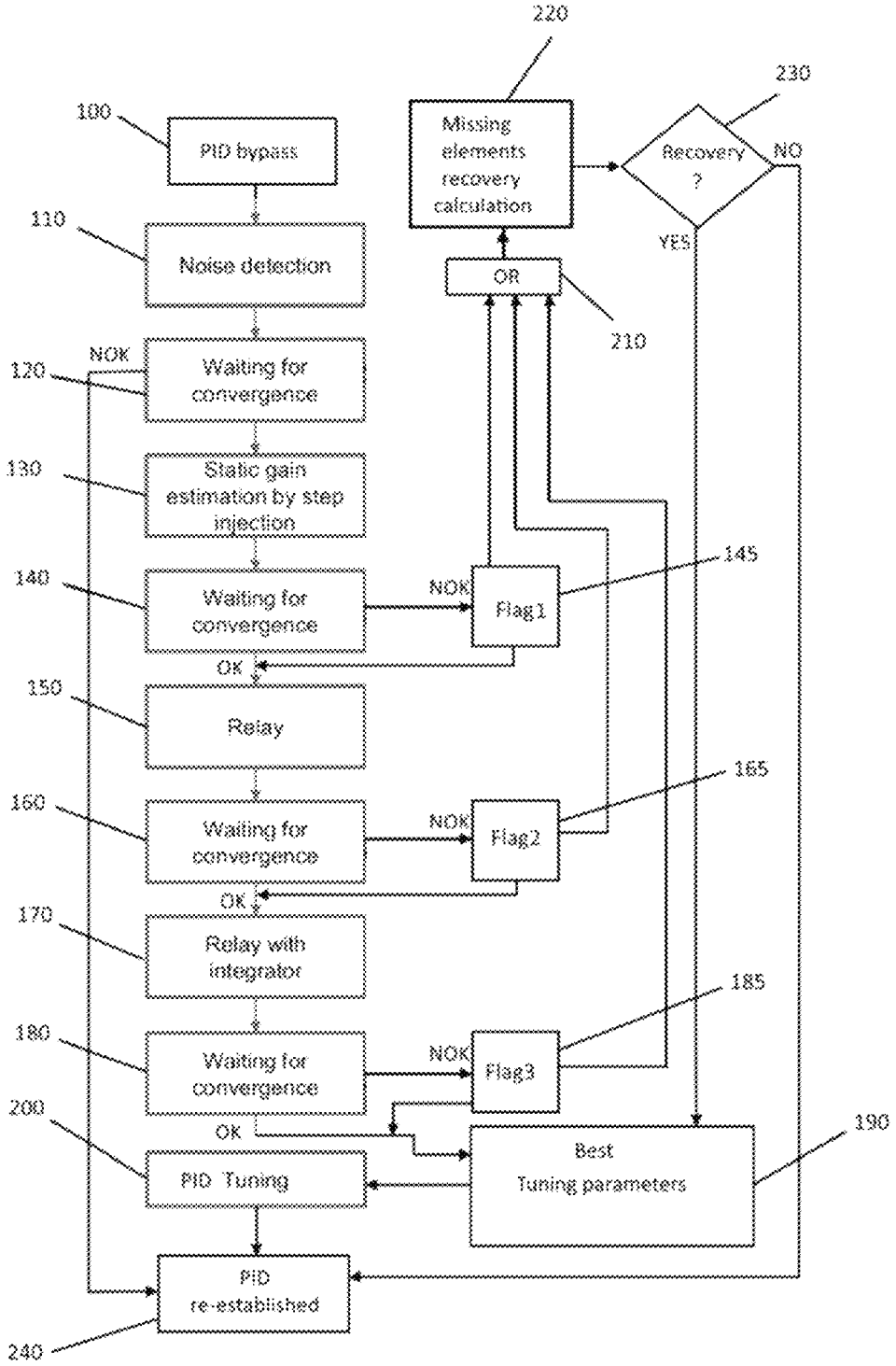
FIG. 8 shows an example of possible simplified flowchart of implementation of processes of the depicted method.

A possible software implementation of the method may be in accordance with the flowchart of FIG. 8. Such software could be integrated in the process control device or motor control device already incorporating the PID control software.

The method starts with bypassing the PID at 100, then a noise detection process 110 be done with a first convergence detection process 120 which may cause ending of the process and direct reestablishment of the PID 240 if convergence cannot be obtained. After noise detection, the three method disclosed hereabove may be initiated. In the presented chart, the method follows with the static gain estimation with the step injection process 130, waits for convergence 140 and exits if convergence cannot be obtained a flag 145 is raised.

The second process, Relay 150 to obtain the critical point follows the step injection and comprises also a detection of convergence 160 which stops the Relay and raises a flag 165 if convergence cannot be obtained.

The third process is the Relay with integrator 170 to obtain the point at 90° of phase on the Nyquist curve which also has its convergence detection step 180 which raise a third flag 185 if not obtained.

It should be noted that the tree processes may be implemented in a different order e.g. with the step integration in the last position and the relay with integrator in the first position.

When the processes are completed, a calculation of best tuning parameters 190 is done to provide PID tuning 200 and re-establish 240 the PID with updated parameters.

In case one of the processes did not converge at gate 210 a missing element recovery calculation is done at 220 and if recovery is possible at 230, the recovered data is transferred to the best tuning parameters step 190 otherwise the PID is re-established unchanged.

INDUSTRIAL APPLICABILITY

The technical solutions presented here can be used to tune hydraulic processes such as water or gas distribution with regulated pressure or regulated flow.

This disclosure is not limited to the above description and in particular as already said, the three processes step injection, periodic relay command and periodic relay command with integration may be realized in any order.

The invention claimed is:

1. A method for calculating PID parameters of a fluid system comprising a motor driving a pump, a compressor or a fan, the fluid system further comprising a feedback sensor providing a feedback signal on the system and a PID regulation controlling a speed of the motor, wherein the method comprises:

after an initial approximation of the fluid system by a first order transfer function with delay of a form of $$P_{estim(S)} = \frac{K \cdot e^{-\theta \cdot s}}{1 + \tau \cdot s}$$

where three parameters of the transfer function of a process to be identified are K Static gain, θ Delay, τ Time constant, performing one or more sequences of:

bypassing the PID regulation controlling the speed of the motor; implementing each of:

a periodic relay process providing a first point ($\omega_{-180}$;$G_{-180}$) at −180° of phase named critical point, a periodic relay with integration process providing a second point ($\omega_{-90}$;$G_{-90}$) at −90° of phase and, a step injection process providing a third point $G_0$ at ω=0° of phase and at null frequency;

resolving:

$$G_0 = K$$

$$G_{-90} = \frac{K}{\sqrt{1 + (\tau \cdot \omega_{-90})^2}}$$

$$\cos(\omega_{-90} \cdot \theta) - \omega_{-90} \cdot \tau \cdot \sin(\omega_{-90} \cdot \theta) = 0$$

$$G_{-180} = \frac{K}{\sqrt{1 + (\tau \cdot \omega_{-180})^2}}$$

$$\sin(\omega_{-180} \cdot \theta) - \omega_{-180} \cdot \tau \cdot \cos(\omega_{-180} \cdot \theta) = 0$$

according to the first point, the second point, and the third point to calculate the transfer function parameters available among:

$$K = G_0$$

$$\tau = \frac{1}{\omega_{-180}} \sqrt{\left(\frac{K}{G_{-180}}\right)^2 - 1}$$

$$\theta = \left(\tan^{-1}(\omega_{-180} \cdot \tau) + \pi\right) \cdot \frac{1}{\omega_{-180}};$$

applying the transfer function parameters obtained to calculate PID parameters for the system regulation:

$$\begin{cases} K_p = \dfrac{\tau}{K \cdot (\lambda + \theta)} \\ T_i = \tau \\ T_d = \theta \end{cases}$$

where λ=α·max(τ,θ) and α is between 0.1 to 2; and then reestablishing the PID regulation controlling the speed of the motor.

2. The method according to claim 1, wherein $T_d$ is approximated to zero.

3. The method according to claim 1, wherein said step injection process comprises, inputting a step having an amplitude Δu to a current speed command of the motor, waiting for process feedback convergence, measuring a feedback signal value Δv, and calculating said static gain K as Δv/Δu.

4. The method according to claim 3, wherein having the amplitude Δu is limited in order not to exceed an upper limit $s_h$ of the motor speed.

5. The method according to claim 3, wherein the waiting for process feedback convergence includes detecting the convergence, the detecting convergence comprises periodically providing measures of a feedback signal sample and comparing the measures of the feedback signal sample to a mean value of the measures of the feedback signal sample based on a dedicated number of samples, comparing an absolute difference between said measures and said mean value, confirming achievement of the convergence when said absolute difference remains under a defined limit for a specified period of time.

6. The method according to claim 5, wherein any one of said step injection process, said periodic relay process, and said periodic relay process with integration is aborted and the PID regulation is reestablished if the convergence is not achieved within a stipulated time limit or if the feedback signal exceeds a stipulated amplitude limit.

7. The method according to claim 6, wherein in case the convergence is not achieved, recovery of missing elements is done with:

If $(\omega_{-90};G_{-90})$ AND $(\omega_{-180};G_{-180})$ are known:

If $G_0$ is known:

$K=G_0$

Else:

$$K = G_{-90} \cdot G_{-180} \cdot \sqrt{\frac{\omega_{-90}^2 - \omega_{-180}^2}{(\omega_{-90} \cdot G_{90})^2 - (\omega_{-180} \cdot G_{180})^2}}$$

$$\text{Or } K = G_{-90} \cdot \sqrt{2} \text{ in case } \frac{\omega_{-90}^2 - \omega_{-180}^2}{(\omega_{-90} \cdot G_{90})^2 - (\omega_{-1} \cdot G_{180})^2}$$

is negative $$\tau = \frac{1}{\omega_{-9}} \sqrt{\left(\frac{K}{G_{-90}}\right)^2 - 1}$$

$$\theta = \tan^{-1}\left(\frac{1}{\omega_{-90} \cdot \tau}\right) \cdot \frac{1}{\omega_{-9}}$$

If $(\omega_{-90};G_{-90})$ is known:

If $G_0$ is known:

$K=G_0$

Else:

$K=G_{-90} \cdot \sqrt{2}$ $$\tau = \frac{1}{\omega_{-90}} \sqrt{\left(\frac{K}{G_{-90}}\right)^2 - 1}$$

$$\theta = \tan^{-1}\left(\frac{1}{\omega_{-90} \cdot \tau}\right) \cdot \frac{1}{\omega_{-90}}$$

If $(\omega_{-180};G_{-180})$ is known:

If $G_0$ is known:

$K=G_0$

Else:

$K=G_{-180}\sqrt{2}$ $$\tau = \frac{1}{\omega_{-18}} \sqrt{\left(\frac{K}{G_{-180}}\right)^2 - 1}$$

$$\theta = \left(\tan^{-1}(\omega_{-180} \cdot \tau) + \pi\right) \cdot \frac{1}{\omega_{-180}}.$$

8. The method according to claim 1, wherein said periodic relay process comprises:

providing a series of relay switching on sign changes of the feedback signal, waiting for convergence of the feedback signal, and measuring a relay period T, a feedback amplitude A and a relay amplitude d thus providing a critical period $T_u$=T and a critical gain $$K_u = \frac{4 \cdot d}{\pi \cdot A/2},$$

9. The method according to claim 8, wherein the relay amplitude d is limited in order that the speed of the motor does not to exceed defined upper and lower limits $s_h$, $s_i$.

10. The method according to claim 1, wherein said periodic relay with integration process comprises:

applying a series of ramps or relay switching with integration around a last PID output wherein the relay switches on sign change of the feedback signal;

analyzing convergence of the feedback signal and when convergence is achieved recording a point at 90° of phase at a relay period T and calculating:

$$\text{Input amplitude: } D = 2 \cdot d = G \cdot \frac{T}{2},$$

$$\text{Process period @ } -90° \text{ phase: } T_{90} = T,$$

$$\text{Process gain @ } -90° \text{ phase: } K_{-90} = \frac{\pi^2}{8} \cdot \frac{\frac{A}{2}}{d} = \frac{\pi^2 \cdot a}{8 \cdot d},$$

and where A is a peak-to-peak amplitude of the feedback signal, D=2·d is the peak-to-peak amplitude of the relay signal, G is a slope of relay triangle waves.

11. The method according to claim 1, wherein said one or more sequences are repeated from time to time during an operational life of the fluid system to calculate the PID parameters adapted to ageing of the fluid system.

12. A method for calculating PID parameters of a fluid system comprising a motor driving a pump, a compressor or a fan, the fluid system further comprising a feedback sensor on the system to provide a PID regulation controlling the speed of the motor, the method comprising:

choosing settings between settings based on the method of claim 1 and settings based on Ziegler Nichols method or choosing settings based minimal proportional gain, maximal integral time constant and minimal derivative time constant $$K_p = \min\left(0.4 \cdot K_{cr}; \frac{\tau}{K \cdot (\lambda + \theta)}\right); T_i = \max(0.8 \cdot T_{cr}; \tau); T_d = 0$$

between the method of claim 1 and the Ziegler Nichols method; where

Critical gain $$K_{cr} = \frac{4 \cdot d}{\pi \cdot A/2},$$

A is feedback amplitude, d is relay amplitude, Critical period $T_{cr}$=T, and T is relay period.

13. A process for tuning a PID regulated process comprising calculating PID parameters with the method as claimed in claim 1, and reestablishing the PID regulation with the calculated PID parameters.

14. A control device to calculate PID parameters of a fluid system comprising a motor driving a pump, a compressor or a fan, the fluid system further comprising a feedback sensor providing a feedback signal on the system and a PID regulation controlling a speed of the motor, wherein the control device is configured to:

after an initial approximation of the fluid system by a first order transfer function with delay of a form of $$P_{estim(S)} = \frac{K \cdot e^{-\theta \cdot s}}{1 + \tau \cdot s}$$

where three parameters of the transfer function of a process to be identified are K Static gain, θ Delay, τ Time constant, perform one or more sequences of:

bypassing the PID regulation controlling the speed of the motor;

implementing each of:

a periodic relay process providing a first point ($\omega_{-180}$;$G_{-180}$) at −180° of phase named critical point, a periodic relay with integration process providing a second point ($\omega_{-90}$;$G_{-9}$) at −90° of phase and, a step injection process providing a third point $G_0$ at ω=0° of phase and at null frequency;

resolve:

$$G_0 = K$$

$$G_{-90} = \frac{K}{\sqrt{1 + (\tau \cdot \omega_{-90})^2}}$$

$$\cos(\omega_{-90}) - \omega_{-9} \cdot \tau \cdot \sin(\omega_{-90} \cdot \theta) = 0$$

$$G_{-180} = \frac{K}{\sqrt{1 + (\tau \cdot \omega_{-180})^2}}$$

$$\sin(\omega_{-18} \cdot \theta) - \omega_{-180} \cdot \tau \cdot \cos(\omega_{-180} \cdot \theta) = 0$$

according to the first point, the second point, and the third point to calculate the transfer function parameters available among:

$$K = G_0$$

$$\tau = \frac{1}{\omega_{-180}} \sqrt{\left(\frac{K}{G_{-180}}\right)^2 - 1}$$

$$\theta = \left(\tan^{-1}(\omega_{-18} \cdot \tau) + \pi\right) \cdot \frac{1}{\omega_{-180}};$$

apply the transfer function parameters obtained to calculate PID parameters for the system regulation:

$$\begin{cases} K_p = \dfrac{\tau}{K \cdot (\lambda + \theta)} \\ T_i = \tau \\ T_d = \theta \end{cases}$$

where λ=π·max(τ,θ) and α is between 0.1 to 2; and then reestablish the PID regulation controlling the speed of the motor.

15. The control device according to claim 14, wherein $T_d$ is approximated to zero.

16. The control device according to claim 14, wherein said step injection process comprises inputting a step having an amplitude Δu to a current speed command of the motor, waiting for process feedback convergence, measuring a feedback signal value Δv, and calculating said static gain K as Δv/Δu.

17. The control device to claim 16, wherein having the amplitude Δu is limited in order not to exceed an upper limit $s_h$ of the motor speed.

18. The control device according to claim 14, wherein said periodic relay process comprises:

providing a series of relay switching on sign changes of the feedback signal, waiting for convergence of the feedback signal, and measuring a relay period T, a feedback amplitude A and a relay amplitude d thus providing a critical period $T_u$=T and a critical gain $$K_u = \frac{4 \cdot d}{\pi \cdot A/2}.$$

19. The control device according to claim 18, wherein the relay amplitude d is limited in order that the speed of the motor does not to exceed defined upper and lower limits $s_h$, $s_i$.

20. The control device according to claim 14, wherein said periodic relay with integration process comprises:

applying a series of ramps or relay switching with integration around a last PID output wherein the relay switches on sign change of the feedback signal;

analyzing convergence of the feedback signal and when convergence is achieved recording a point at 90° of phase at a relay period T and calculating:

$$\text{Input amplitude: } D = 2 \cdot d = G \cdot \frac{T}{2},$$

$$\text{Process period @ } -90° \text{ phase: } T_{90} = T,$$

$$\text{Process gain @ } -90° \text{ phase: } K_{-90} = \frac{\pi^2}{8} \cdot \frac{\frac{A}{2}}{d} = \frac{\pi^2 \cdot a}{8 \cdot d},$$

and where A is a peak-to-peak amplitude of the feedback signal, D=2·d is the peak-to-peak amplitude of the relay signal, G is a slope of relay triangle waves.

* * * * *